United States Patent [19]

Kowalski

[11] 4,005,463

[45] Jan. 25, 1977

[54] PHOTOGRAPHIC PROCESSING DRUM AND METHOD FOR USING

[75] Inventor: Charles J. Kowalski, New York, N.Y.

[73] Assignee: Charles Beseler Company, Florham Park, N.J.

[22] Filed: July 8, 1975

[21] Appl. No.: 593,986

[52] U.S. Cl. ..... 354/307; 354/335

[51] Int. Cl.[2] ..... G03D 17/00

[58] Field of Search ..... 354/307, 312, 323, 328, 354/329, 330, 331, 335

[56] References Cited

UNITED STATES PATENTS

| | | | |
|---|---|---|---|
| 3,589,264 | 6/1971 | Jensen | 354/323 X |
| 3,595,158 | 7/1971 | Long | 354/307 |
| 3,626,834 | 12/1971 | Speranza | 354/329 X |
| 3,677,163 | 7/1972 | Porter | 354/307 |
| 3,703,860 | 11/1972 | Wilkinson | 354/329 X |
| 3,705,544 | 12/1972 | Ratowsky | 354/329 X |
| 3,879,119 | 4/1975 | Ratowsky | 354/335 |

*Primary Examiner*—Fred L. Braun
*Attorney, Agent, or Firm*—Darby & Darby

[57] ABSTRACT

A photographic processing drum includes a trough coaxially arranged within and spaced apart from the interior surface of the drum. A cap sealingly fitted to one end of the drum includes separate channels, isolated from each other, for conducting fluids into and out of the drum. Fluids introduced into the inlet channel are emptied directly into the trough without first contacting the interior surface of the drum. A method for employing the photographic drum in the processing of light-sensitive emulsions is also discussed.

19 Claims, 5 Drawing Figures

10
12
14
16
18
22
24
26
32
34
36
38
40
42
44
46
46A
48
50
50-B
51
52
54
56
58
60
62
64
66
68
70
72
74
76
78
80
82
83
84
85
86
88
90
92
3
4
5

PHOTOGRAPHIC PROCESSING DRUM AND METHOD FOR USING

This invention relates to the art of processing photographic silver halide emulsions and more particularly to a new photographic processing drum for use in the development of image-wise exposed light-sensitive emulsions.

Until recently, the apparatus for developing photographic prints generally comprised several trays or receptacles capable of holding photographic print papers undergoing various treatments in the development sequence. The size and arrangement of the preceding apparatus generally required that the development sequence be carried out in a fairly large area which remained darkened throughout the chemical treatment operation.

Within the past several years, simplified developing apparatus for processing photographic prints, and particularly color prints, has become available. In general, such apparatus has consisted of a drum-shaped container bearing a removable cap. Photographic paper is introduced into the drum after image-wise exposure, and the cap replaced on the container to make the drum light-tight. Thereafter, all further processing steps may be carried out by the operator in ordinary room light by introducing and removing the required chemical fluids through a light-tight port in the top surface of the cap.

Although the foregoing apparatus simplified the procedures for developing prints, and especially color prints, to a substantial extent, it is subject to several disadvantages. The principal drawback lies in difficulty of obtaining uniform development of the print being processed. Non-uniform development is largely attributable to the fact that as the various chemical fluids are poured into the container through the orifice in the cap, those portions of the print closest to the upper surface of the processing drum remain in contact with the developing chemicals for a proportionately longer period of time than the corresponding print areas located in the upper portion of the tank. Since the developing solutions are introduced through the top of the tank, they first contact the portion of the paper closest to the entry port and thus, as the fluid runs down along the surface of the print, the portion of the print first contacted by the developer begins to develop sooner, therefore causing unequal development and consequent staining. Another drawback is that the prior art drums have delivery channels which do not afford rapid drainage of fluids from within the container after a particular processing step had been completed, thus preventing accurate measurement of processing time periods. This also contributes to non-uniform development.

Because the same orifice is used for introduction and removal of fluids from the drum, contaminant substances evolved during the developing operation tend to accumulate in this passageway thereby contaminating any fresh chemicals subsequently delivered into the tank through the passage.

The prior art arrangements are also generally dependent upon a recess or depression in the interior surface of the developing container to hold the photographic printing paper being processed in a relatively fixed position for treatment. Such recessed areas serve to collect developing fluid contaminants which cannot easily be removed absent complete opening of the container and thorough washing.

Another drawback of the prior art devices is that they require the use of fairly substantial quantities of chemical fluids to process a single print, usually on the order of three or more ounces of solution for a conventional eight-inch by ten-inch photographic enlargement. Since the spent photographic solutions are generally discarded after processing a single sheet (especially in processing color prints) and such solutions are fairly expensive, it is desirable to use the smallest fluid volume consistent with proper development of the entire photographic emulsion.

It is a principal object of the present invention to provide an improved apparatus for developing light-sensitive photographic material such as film, paper and the like.

More specifically, it is an object of the present invention to provide an improved apparatus for developing color as well as black and white photographic prints.

A still further aspect of this invention is to provide a light-tight developing vessel which facilitates complete and rapid contact of substantially all of the surface of a photographic print with a processing fluid so that the entire print receives essentially uniform development.

Another object is to provide a film-processing container which enables print development to be carried out with a relatively small quantity of chemicals.

A still further aspect of the invention is the provision of a developing container which can be filled and emptied in a rapid fashion through separate, isolated passageways thereby eliminating the likelihood that chemical contaminants may contact fresh developing fluids.

These and other objects and advantages of the present invention will be apparent from the following description.

According to the present invention, an apparatus for developing photographic materials is provided consisting of a light-tight tubular container sealingly fitted at both axial ends with fluid-tight caps. A generally convex trough is affixed to a cap at one end of the container and is coaxially disposed within the container and spaced apart from the interior container surface when the cap is fitted into place. A second cap is fitted to the other end of the container and bears an outwardly projecting spout and an interior passageway in direct communication with the spout and an orifice on the interior surface of the cap. The orifice is disposed above the open end of the trough and processing solutions poured into the spout are directly conducted via the passageway and the orifice into the trough without first contacting an inner container surface.

The end cap bearing the spout also contains a duct network connected to an outlet collection gallery through which fluids may be rapidly emptied from the drum into a chamber passing beneath the floor of the spout. The outlet collection gallery and passageways are separate and isolated from the inlet channels to prevent contamination of fresh photographic solutions. A dovetailed groove on the floor of the drum cooperates with a movable rail to provide a spacer for dividing the inside circumference of the container into two or more compartments of equal dimension for holding smaller sized photographic sheets. Means are also provided for further subdividing the interior drum surface circumferentially and axially in order to accommodate printing papers and films of differing dimensions.

The invention will be further illustrated and described with reference to the accompanying drawings wherein.

Figures 1, 2:
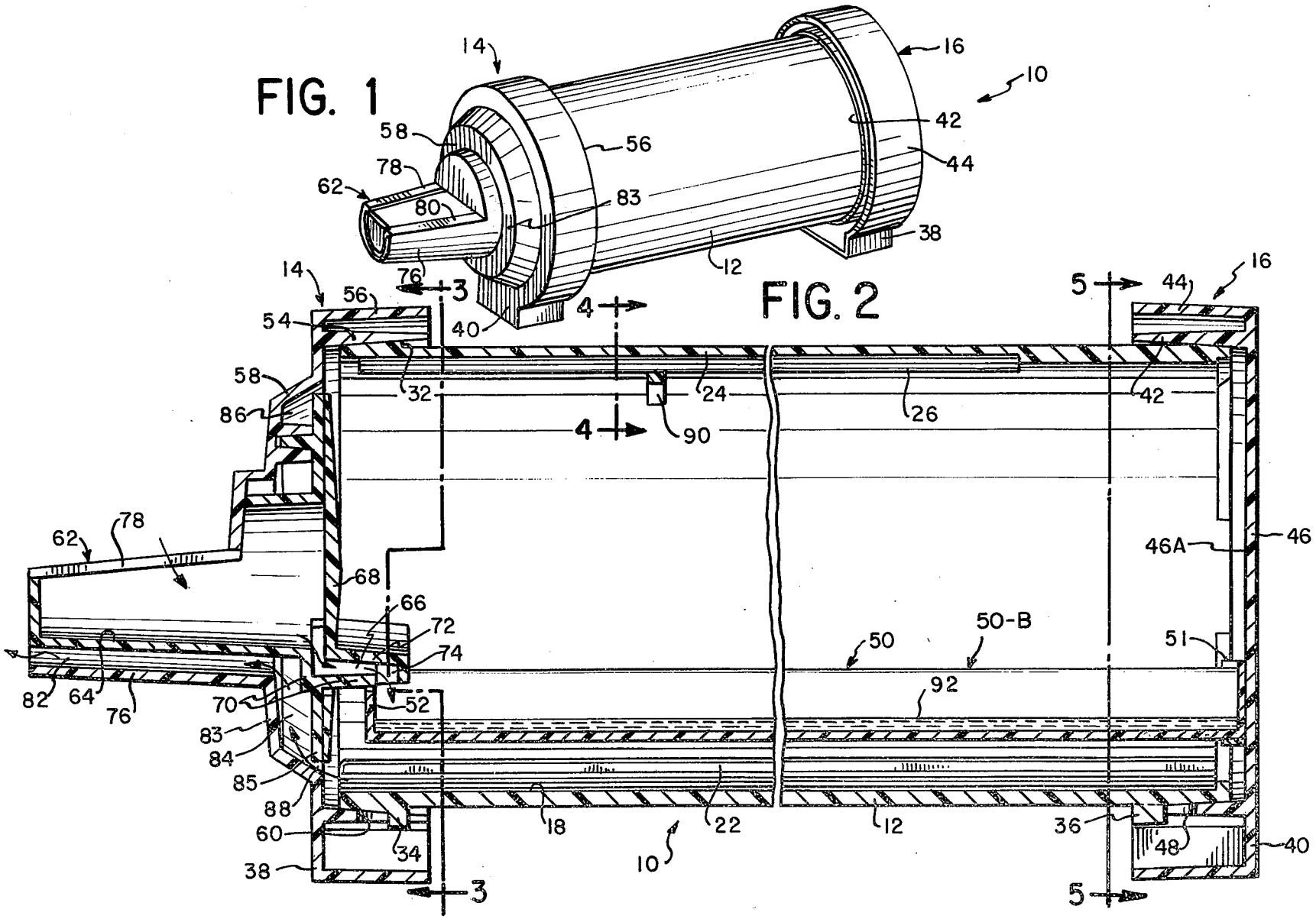
FIG. 1 represents a perspective view of a photographic processing drum according to the invention.
FIG. 2 is a longitudinal cross section of the device illustrated in FIG. 1.

Referring now to FIG. 1 of the drawing, a processing drum 10 constructed in accordance with the present invention is illustrated. The principal elements of the drum construction are a generally tubular-shaped body member 12 and a pair of substantially circular end caps 14 and 16 which are used to seal each end of body member 12. When the drum is in actual use, caps 14 and 16 are in sealing fluid-tight communication with body member 12; however, each may be removed to permit access to the interior surfaces of body member 12 for insertion of photographic paper sheets or cleaning.

Figure 3:
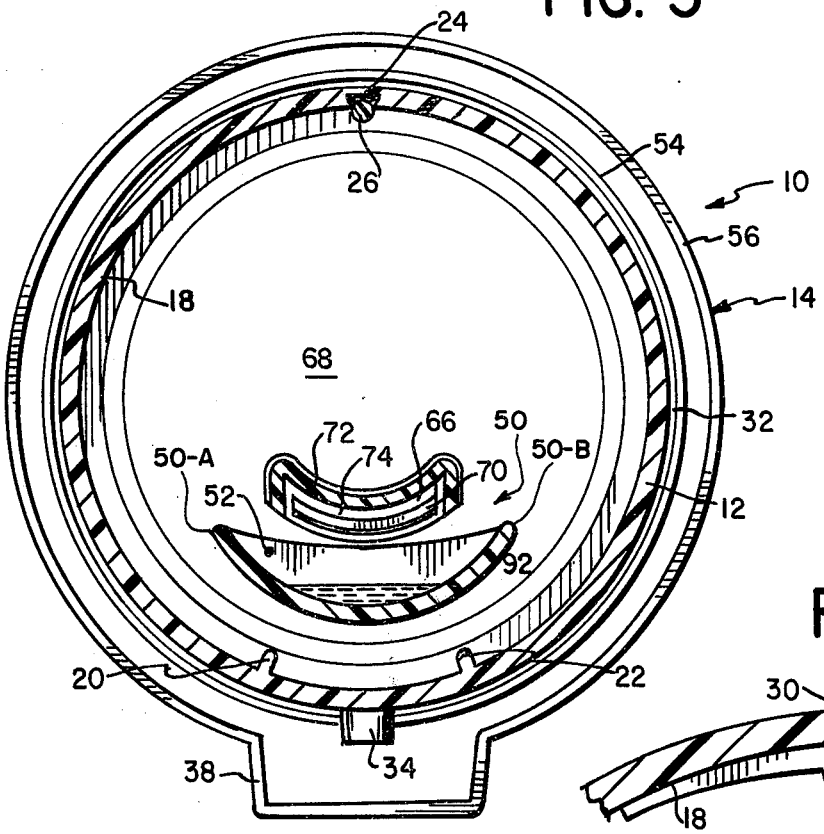
FIG. 3 is a sectional view taken substantially along line 3—3 of FIG. 2.

The internal construction features of body member 12 will be better understood by reference to FIGS. 2 and 3 in which it will be seen that its inner surface 18 is substantially smooth and is interrupted only by a pair of spaced-apart rails 20 and 22 which are elevated slightly above the drum surface. The rails are spaced a predetermined circumferential distance apart to accommodate one dimension of a standard sized photographic printing sheet. A dove-tailed-shaped groove 24 extends along the axis of the container and is positioned in the middle of the larger circumferential dimension separating rails 20 and 22. An elongate rod-shaped member 26 may be slidably inserted into groove 24 by means of projections 30 and 30*a* which cooperate with the walls of the groove 24. The rod 26 serves as a spacer and effectively divides the interior drum circumference between rails 20 and 22 into equal size compartments to accommodate a plurality of smaller size printing films and papers.

The forward end of the body member 12 bears an elevated shoulder portion 32 for engaging the corresponding end cap and a stub-shaped locating key 34 which protrudes above the shoulder. The opposite end of body member 12 tapers to a slightly reduced diameter and carries a stub-shaped locating key 36. The locating keys 34 and 36 are horizontally aligned with one another and serve to permit rapid alignment and seating of end caps 14 and 16 on body member 12.

Both end caps 14 and 16 have integrally formed rectangular base portions 38 and 40 which permit the processing drum to rest in a stationary position upon a flat surface such as a table or counter top during the loading of the chemical solutions or when the drum is not in use. The base portions also serve a further function which will be described hereafter.

Figure 5:
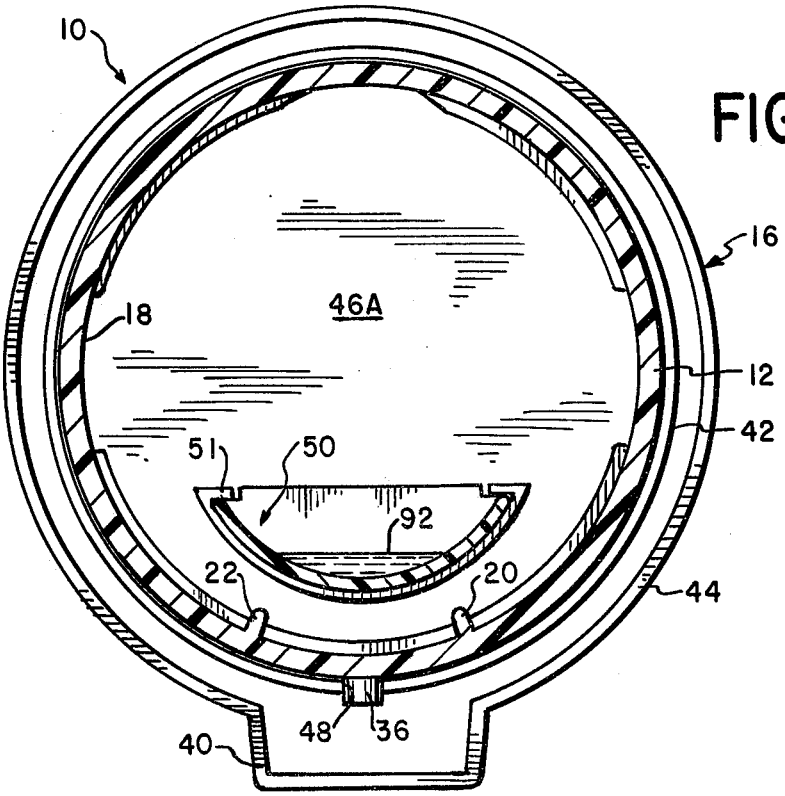
FIG. 5 is a sectional view taken substantially along line 5—5 of FIG. 2.

Referring to FIGS. 2 and 5, it can be seen that the rearward cap 16 is constructed of two essentially concentric rings, inner ring 42 and outer ring 44 which are integrally formed with an end wall 46. A generally U-shaped segment 48 is cut out from the forward edge of inner ring 42 on the portion of the ring directly above the flat segment of base section 38. The cut-out receives the stub-shaped locating key 36 positioned at the rearward end of body member 12, thus enabling rapid and accurate alignment of cap 16 with the body member. A trough 50 having side walls 50-*a* and 50-*b* is permanently affixed, as for example by bracket 51, to the inner surface 46-A of end wall 46. The trough is illustrated as having a generally concave shape, although any suitable cross-sectional design may be employed which will function as a receptacle for fluids. The trough is spaced apart from and parallel to inner ring 42. The distal end of the trough bears a vertical wall 52 which prevents the escape of liquid held in the trough.

The length of trough 50 is just slightly less than that of the container in order to permit the forward wall 52 to clear the inner wall of forward cap 14. In no case is the length of trough 50 less than that of rails 20 and 22. It is important that the trough be sufficiently long so that vertical wall 52 is positioned forward of the fluid entry orifice 74 when cap 14 is seated on body member 12.

Referring to FIGS. 1 and 3, it will be seen that the construction of forward cap 14 also consists of two generally concentric rings, an inner ring 54 and an outer ring 56, which are integrally formed with a body portion 58. The surface of the inner ring 54 adjacent to the flat base portion 40 bears a U-shaped cut-out 60 which serves to receive the stub-shaped locating key 34 positioned on the forward end of body 12. The U-shaped cut-outs 48 and 60 afford rapid means for positioning and aligning the end caps with the tubular body member 12.

The body portion 58 tapers forwardly to form a spout 62. The floor 64 of spout 62 is inclined slightly downward in the direction of rear cap 16 and communicates with a passageway 66 formed between a rearward wall 68 of body portion 58 and an offset segment 70 of the spout floor. A stepped roof segment 72 defines the upper confines of the passageway 66 within body 12. The stepped roof 72 juts forward from the bottom of rearward wall 68 and has a generally concave cross section which may be seen in FIG. 3. The passageway 66 terminates in an orifice 74 through which fluids enter the interior of the body 12 and pour into the trough 50. A sleeve 76 projects forwardly from body portion 58 in general coaxial alignment with the floor 64 of spout 62. Cover members 78 and 80 are integrally formed with the sleeve 76 and together with the floor 64 of spout 62 define a channel 82 which communicates with a chamber 84 formed between a forwardly projecting segment 83 of body portion 58 and a downwardly extended segment 85 of floor 64. Chamber 84 communicates with a circular hollow groove 86 defined between the forwardly projecting segment 83 and the rearward wall 68 of body portion 58 which runs around the inside circumference of cap 14.

Cap 14 can be matingly seated on body member 12 by aligning stub 34 with slot 60 and sliding inner ring 54 up onto the shoulder projection 32 thereby forming a water-tight fit. In a similar fashion, rear cap 16 can be located on body member 12 by aligning stub 36 and slot 48, permitting inner ring 42 to be seated in fluid-tight engagement directly on body member 12.

The entire drum assembly including the end caps is desirably fabricated from a rigid synthetic plastic material which is resistant to chemical attack by photographic processing solutions. The plastic material must be opaque in order to avoid fogging the photographic paper in the event processing is carried out in room light. Alternatively, the entire construction may be made of a metal, e.g. stainless steel, which is resistant to photograhic processing chemicals.

The construction of the drum will be better understood by reference to the following exemplary illustration of the method in which it may be used to develop exposed photographic images.

Prior to commencing the processing operation, at least one of the caps 14 and 16 is removed from body member 12. Preferably, only forward cap 14 is removed, and the drum rested on end wall 46 of cap 16. A sheet of image-wise exposed photographic enlarging paper is cupped to form a cylinder and then inserted downwardly into the drum with the emulsion side facing upward toward the center of body member 12 and away from the container walls. The sheet is seated in the space defined between rails 20 and 22 having been selected to be of the proper dimension (e.g. 8 × 10 inch) to fit the circumferential spacing (e.g. 10 inch) between these rails. If it is desired to process more than one photographic sheet of a smaller size (e.g. 5 × 7 inch), rod member 26 is positioned in groove 24 to subdivide the interior wall of the body 12 into two equal size compartments. This permits two exposed sheets of similar dimensions to be seated within the body, one between rail 22 and rod member 26 and the other between rail 20 and rod 26. The drum is then sealed by replacing the cap 14 (or caps) on the body 12, proper alignment of the orifice 74 over trough 50 being insured by the insertion of key 34 in cut-out 60. Although the preceding operation must be carried out under photographic safe light conditions, the remainder of the processing sequence can be conducted in ordinary room light in the drum assembly as the drum construction prevents light from penetrating into body 12 after the caps 14 and 16 are firmly in position.

After the drum has been sealed, base portions 38 and 40 are rested on a flat surface. A predetermined quantity of a conventional developing solution 92 is then poured into spout 62. The solution will flow downwardly along the rearward slanted floor 64 into passageway 66 and pour through orifice 74. The locating stubs 34 and 36 assure the alignment of the distal end of trough 50 beneath orifice 74 when caps 14 and 16 are seated in the tubular body 12. Thus, the fluid 92 will flow from orifice 74 directly into trough 50. Vertical wall 52 projects upward toward the offset spout floor extension 70 to prevent fluid from leaking or splashing out of the trough and onto the underlying exposed photographic sheets.

When fluid is no longer visible on the floor of spout 64, the operator inverts the drum and commences to roll it backward and forward along the tabletop on the outer rings 56 and 44 of caps 14 and 16. As soon as the drum is inverted, the developer solution 92 in the trough 50 descends in a liquid curtain across the length of the sheet (or sheets) of photographic paper disposed between the respective rails 20 and 22 and the rod 26. As back-and-forth agitation begins almost simultaneously with inversion of the drum, the entire paper surface is quickly contacted by the developer and is subject to essentially equal development time as the tank is rolled on end caps 14 and 16, thus preventing uneven development or staining of certain print areas. Since a small pool of solution remains at the lower part of the drum and contacts the upward facing surface of the photograhic emulsion as the drum is rolled back and forth, a minimal volume of solution is required. As the trough 50 is elevated above the interior drum surface 28 on which the photographic sheet is resting, the chemicals do not contact the photographic emulsion until the drum is inverted and agitation begun, thus eliminating streaking. In the preferred embodiment of the invention illustrated herein, it is possible to process two 8 × 10 color print papers in the drum with as little as 1½ ounces of developer. Premature drainage of the developing solution from the tank during agitation does not occur since the level of fluid is always considerably beneath the level at which it might begin to flow through outlet channel 82.

When it is desired to empty the liquid contents, the drum is inverted and the spout pointed downwardly at about a 45° angle to permit the contents to drain out through the outlet channel 82. It will be appreciated that the liquid contents of the drum can enter channel 82 through drain slit 88 and groove 86 which run around the circumference of body portion 58 on the interior of the drum and communicate directly with chamber 84 which empties into channel 82. No portion of the exhausted solution will drain through the inlet passageway 66 to contaminate the spout since the orifice 74 is above the level of the drain slit 88 which opens into groove 86 when the tank is inverted for drainage.

Figure 4:
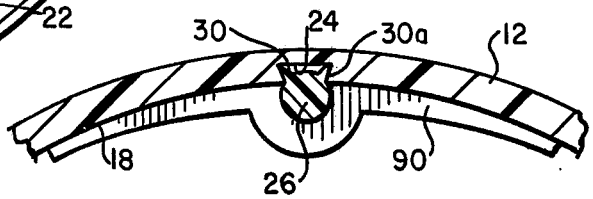
FIG. 4 is a sectional view taken substantially along line 4—4 of FIG. 2.

In the event it is desired to process smaller size sheets, a divider 90 contoured to the inner surface 18 of body 12, illustrated in FIGS. 2 and 4, can be affixed to the rod-shaped member 26. By moving the divider along the rod-shaped member, the inside circumference of body member 12 is further subdivided into compartments for holding a plurality of smaller size sheets (e.g. four 4 × 5 inch prints) in position between the rod member 26 and rail 20 or 22. The same quantity of photographic chemicals is required, irrespective of whether the drum is loaded with one or two large size sheets or with multiple small sheets of paper or film. Disassembly of the drum for cleaning or loading paper sheets is accomplished by removing the end caps 14 and 16 from body member 12. The caps may be repositioned on body member 12 by simply realigning locating keys 34 and 36 with their corresponding cutouts 48 and 60.

What is claimed is:

1. A photographic processing drum comprising a tubular body member, a trough mounted within said body member and spaced apart from the interior surface thereof, the longitudinal axis of said trough being substantially parallel to the longitudinal axis of said body member, a cap sealingly fitted to one end of said body member and bearing an outwardly projecting spout, and a fluid entry passageway in communication with said spout and with an orifice at the interior surface of said cap, the orifice being positioned over said trough to discharge in the trough fluid supplied to said spout when said drum is in a horizontal position, said trough comprising means for holding the fluid received therein isolated from the interior surface of said drum when said trough is positioned to receive fluid from said orifice and also having an open top extending substantially parallel to the longitudinal axis of said body member for dispensing said fluid substantially simultaneously over a side wall of said trough in response to rotation of said drum about its horizontal axis.

2. A photographic processing drum as recited in claim 1 comprising a base section on an outer portion of said drum for standing said drum in said fluid receiving position, and the open top of said trough facing away from said base section.

3. A photographic processing drum as recited in claim 2 wherein said spout bearing cap includes a fluid drainage channel isolated from said passageway and extending outward from said cap along said spout.

4. A photographic processing drum as recited in claim 3 wherein said fluid drainage channel substantially conforming to the shape of said spout.

5. A photographic processing drum as recited in claim 3 comprising a pair of longitudinal, spaced-apart, rails mounted on the inner surface of said body member and a rod member mounted on the inner surface of said body member midway in the circumferential distance between said rails.

6. A photographic processing drum comprising a tubular body member, a forward end cap sealingly attached to one end of said body member, a rearward end cap sealingly attached to the other end of said body member, first means for conducting a fluid into said drum, second means positioned within said body member and having an open top extending substantially parallel to the longitudinal axis of said body member for receiving said fluid from said first means and holding said fluid isolated from the interior surface of said body member while said drum is stationed in a first horizontal position and for discharging said fluid over a side wall of said receiving means in response to rotation of said drum about its horizontal axis, said second means having its longitudinal axis substantially parallel to the longitudinal axis of said body member, and means, isolated from the first means, for draining said fluid from the interior surface of said drum.

7. A photographic processing drum according to claim 6 further comprising a base section on an exterior portion of said drum to maintain said drum in said first horizontal position.

8. A photographic processing drum according to claim 7 further comprising a locating stub on said tubular body member, said stub mating with a corresponding cut-out on said forward end cap to align said orifice over an end of said trough.

9. A photographic processing drum according to claim 6 wherein the first means comprises a spout projecting fowardly from the forward cap, a fluid-conducting passageway communicating between the spout and an orifice on the interior surface of said cap, said orifice being juxtaposed over the means for receiving the fluid.

10. A photographic processing drum according to claim 9 wherein the means for receiving said fluid comprises a trough affixed to an inner surface of said drum and extending for substantially the entire length of the body member toward said forward cap, said trough having raised end walls to hold fluid therein when said drum is stationed in said first horizontal position.

11. A photographic processing drum as recited in claim 10 wherein said trough comprises a substantially U-shaped channel affixed to an inner surface of said rearward cap.

12. A photographic processing drum according to claim 10 wherein the means for draining the fluid from the drum comprises a collection channel located on an inner surface of the forward cap, a hollow chamber in the body of the forward cap, and a fluid delivery channel in communication with the chamber and extending beneath the floor of said spout.

13. A photographic drum as recited in claim 10 comprising means for positioning a predetermined number of photographic sheets in a fixed position within said drum.

14. A photographic processing drum as recited in claim 13 wherein the means for positioning the photographic sheets within said drum comprises a pair of longitudinal rails mounted in a predetermined spaced-apart relationship on an inner surface of said drum, and a longitudinal spacer member mounted on an inner surface of said drum and positioned midway between and parallel to the rails.

15. A photographic processing drum as recited in claim 14 comprising a divider element movably mounted on the longitudinal spacer member and shaped to conform to the curvature of the inner surface of said drum.

16. A photographic processing drum comprising a tubular body member, a forward end cap sealingly attached to one end of said body member, a rearward end cap sealingly attached to the other end of said body member, a spout projecting forwardly from said forward end cap and a fluid conducting passageway communicating between said spout and an orifice on the interior surface of said forward end cap, a trough affixed to the rearward end cap and extending substantially parallel to said body member for substantially the entire length of the body member toward the forward end cap, said orifice being juxtaposed over one end of said trough, a pair of longitudinal rails mounted in a predetermined spaced apart relationship on an inner surface of said drum, a longitudinal spacer member mounted on an inner surface of said drum and positioned midway between and parallel to said rails, and said body member bearing a radially projecting stub at each end, and said stubs adapted to mate with a corresponding cut-out on each of said end caps whereby the orifice will be juxtaposed over the trough when said end caps are mounted on said body member.

17. A photographic processing drum comprising a tubular body member, a forward end cap sealingly attached to one end of said body member, a rearward end cap attached to the other end of said body member, a spout projecting forwardly from said forward end cap, a fluid conducting passageway communicating between said spout and an orifice on the interior surface of said forward end cap, a trough affixed to the rearward end cap and extending substantially parallel to said body member for substantially the entire length of the body member toward the forward end cap, said orifice being juxtaposed over one end of said trough, a pair of longitudinal rails mounted in a predetermined spaced apart relationship on an inner surface of said drum, a longitudinal spacer member mounted on an inner surface of said drum and positioned midway between and parallel to said rails, and each of said end caps comprising an essentially circular construction consisting of an outer ring, an inner ring concentric with the outer ring, an end wall integrally formed with and substantially transverse to the plane of each ring, and a flattened base section integrally formed with the outer ring of the cap.

18. A method of developing an exposed photographic sheet which comprises:

positioning said sheet circumferentially about the interior surface of a tubular container with the exposed surface facing the interior of said container, said container having a elongate open top fluid containing trough mounted therein, sealing said container to prevent admission of light, stationing said sealed container in a fixed horizontal position with the longitudinal axis of said container being substantially parallel to the longitudinal axis of said trough, loading a predetermined quantity of a photographic processing fluid into said trough while said trough and said sealed container are resting in said horizontal position, and rotating said container about its horizontal axis to discharge said fluid substantially simultaneously over a side wall of said trough and substantially uniformly along the axial length of said exposed photographic sheet.

19. The method according to claim 18 which comprises sequentially rotating said container in opposite directions through an arc of less than 360° for a predetermined time period to develop said exposed photographic sheet.

* * * * *